US010478980B2

(12) United States Patent
Fischer et al.

(10) Patent No.: US 10,478,980 B2
(45) Date of Patent: Nov. 19, 2019

(54) CUTTER HEAD FOR PERSONAL CARE APPLIANCES

(71) Applicant: Braun GmbH, Kronberg (DE)

(72) Inventors: Uwe Fischer, Darmstadt (DE); Christian Schuebel, Frankfurt am Main (DE); Martin Kluge, Floersheim am Main (DE); Martin Fuellgrabe, Bad Camberg (DE)

(73) Assignee: Braun GMBH, Kronberg (DE)

( * ) Notice: Subject to any disclaimer, the term of this patent is extended or adjusted under 35 U.S.C. 154(b) by 203 days.

(21) Appl. No.: 15/621,014

(22) Filed: Jun. 13, 2017

(65) Prior Publication Data

US 2017/0368700 A1 Dec. 28, 2017

(30) Foreign Application Priority Data

Jun. 24, 2016 (EP) ..... 16176236

(51) Int. Cl.

| | |
|---|---|
| ***B26B 19/14*** | (2006.01) |
| ***B26B 19/28*** | (2006.01) |
| ***B26B 19/32*** | (2006.01) |
| *B26B 19/38* | (2006.01) |

(52) U.S. Cl.

CPC ..... *B26B 19/282* (2013.01); *B26B 19/14* (2013.01); *B26B 19/32* (2013.01); *B26B 19/28* (2013.01); *B26B 19/3886* (2013.01)

(58) Field of Classification Search

CPC ..... B26B 19/14; B26B 19/141; B26B 19/28; B26B 19/282; B26B 19/3846; B26B 19/3853; B26B 19/386; B26B 19/3886; B26B 19/32

USPC ..... 30/43.5, 43.6

See application file for complete search history.

(56) References Cited

U.S. PATENT DOCUMENTS

| | | | | |
|---|---|---|---|---|
| 3,844,033 | A * | 10/1974 | Yonkers | B26B 19/14 30/346.51 |
| 4,001,932 | A * | 1/1977 | Herrick | B26B 19/14 30/43.5 |
| 4,038,747 | A * | 8/1977 | Upton | B26B 19/26 30/34.2 |
| 4,038,748 | A | 8/1977 | Tyler | |
| 4,077,120 | A * | 3/1978 | Herrick | B26B 19/145 30/43.5 |
| 4,896,421 | A | 1/1990 | Geertsma et al. | |
| 5,007,168 | A * | 4/1991 | Messinger | B26B 19/14 30/41.5 |

(Continued)

FOREIGN PATENT DOCUMENTS

| | | |
|---|---|---|
| CN | 101683739 | 3/2010 |
| WO | WO 96/26046 | 8/1996 |

OTHER PUBLICATIONS

European search report dated Dec. 21, 2016.

*Primary Examiner* — Ghassem Alie
*Assistant Examiner* — Bharat C Patel
(74) *Attorney, Agent, or Firm* — Ronald Terk Sia; Kevin C. Johnson

(57) ABSTRACT

An electric shaver having a cutter head with a plurality of cutting rotors driven by a drive train connectable to a motor. The number of tooling rotors is significantly increased while at the same time the size of the tooling rotors is significantly reduced, thus being able to define an approximately smooth surface by the front faces of the tooling rotors.

18 Claims, 6 Drawing Sheets

(56) References Cited

U.S. PATENT DOCUMENTS

| | | | | | |
|---|---|---|---|---|---|
| 5,031,315 | A * | 7/1991 | Labrijn | B26B 19/14 | 30/41 |
| 5,983,502 | A * | 11/1999 | Geertsma | B26B 19/14 | 30/43 |
| 6,151,780 | A * | 11/2000 | Klein | B26B 19/048 | 30/346.51 |
| 6,460,252 | B1 * | 10/2002 | Nakano | B26B 19/141 | 30/346.51 |
| 6,584,691 | B1 * | 7/2003 | Gerasimov | B26B 19/14 | 30/346.51 |
| 6,722,038 | B2 * | 4/2004 | Visman | B26B 19/14 | 30/43.6 |
| 6,979,936 | B1 * | 12/2005 | Ganor | B26B 19/28 | 310/323.01 |
| 7,530,171 | B2 * | 5/2009 | Baron | B26B 19/14 | 30/205 |
| 8,393,082 | B2 * | 3/2013 | Shimizu | B26B 19/14 | 30/43.5 |
| 9,027,251 | B2 * | 5/2015 | Schmitt | B26B 19/14 | 30/41 |
| 2007/0137043 | A1 * | 6/2007 | Kraus | B26B 19/282 | 30/43.9 |
| 2007/0234572 | A1 * | 10/2007 | Hannan | B26B 19/14 | 30/43.92 |

* cited by examiner

CUTTER HEAD FOR PERSONAL CARE APPLIANCES

FIELD OF THE INVENTION

The present invention relates to personal care appliances such as shavers, hair removal devices, nail polishers, skin peeling brushes or toothbrushes having tools of the rotatory type. More particularly, the invention relates to a tool head for a personal care appliance, including a plurality of tooling rotors rotatably supported about rotor axes and a drive train for rotatorily driving said tooling rotors from a motor. The invention also relates to an electric shaver having a cutter head with a plurality of cutting rotors driven by a drive train connectable to a motor.

BACKGROUND OF THE INVENTION

Electric shavers may have one or more rotatory cutter elements which may be driven in an oscillating or a continuous manner by an electric motor connected to the rotatory cutter elements through a drive train transmitting the rotation of the motor shaft to the rotatory cutter elements.

In cutter heads having a plurality of cutting rotors, the driving motion of the motor shaft of the electric motor needs to be distributed to said plurality of cutting rotors what can be achieved by a drive train having a common input element and a plurality of output elements connected to said common input element by means of transmission elements such as meshing gears, chain drive elements or belt drive elements. However, the higher the number of cutting rotors in the cutter head, the more complex the drive train and the higher the number of drive train elements. This may cause problems with accommodating the drive train elements in the cutter head which should have a small size to allow for easy handling of the appliance. In addition, such drive trains are rather noisy in operation due to the meshing gears or the chain engaging with the sprocket wheels.

Moreover, there are not only difficulties in accommodating the drive train elements in the cutter head, but there are also restrictions in accommodating the tooling rotors within a limited functional area and using the available surface of the tooling head for the tooling rotors as effective as possible. Due to the circular cross-section of the tooling rotors allowing rotation thereof, the tooling rotors cannot occupy the entire surface, but need spacing therebetween where there is no tooling effect. In other words, due to the round shape of the tooling rotors, the ratio of the surface area covered by rotors to the surface area not covered by rotors is rather small what results in a restricted tooling efficiency. For example, shaver heads provide for the shaving action only in those areas of the functional surface of the cutter head where there is indeed a rotor, whereas the spacings between the rotors cannot provide for any shaver action.

In addition to such efficiency restrictions, it is difficult to position the tooling rotors to fit with different surface contours to be treated. For example, if the tooling rotors of a shaver are positioned within a common plane, i.e., with their front surfaces in one plane, only those areas of the face having a substantially plane contour can be shaved using all tooling rotors, whereas in other areas of the face such as the chin only some of the tooling rotors contact the skin, whereas others do not. So as to relieve this problem, it has already been suggested to allow for some tilting movements of the tooling rotors to better adapt to the surface contour to be treated. However, such movability of the tooling rotors in addition to the rotation thereof necessitates more complex drive trains and hitherto, such movability could not sufficiently fulfill the need for better adaption of the rotor field to the surface contour to be treated.

For example, EP 15 87 651 B1 shows an electric shaver having three cutting rotors driven by an electric motor via a drive train having a central gear wheel which, on the one hand, is driven by a pinion connected to the motor shaft and, on the other hand, drives three output gear wheels connected to the cutting rotors via output shafts. Although there are only three cutting rotors, there is quite some space needed in the cutting head to accommodate the various gear wheels of the drive train.

A similar electric shaver is shown by EP 17 61 367 B1, wherein each of the cutting rotors is connected to the output drive shaft by means of a sort of ball and socket joint allowing for tilting movements of the cutting rotor, wherein viscoelastic elements are provided for elastically urging the cutting rotors to the skin surface.

An electric shaver having more than three cutting rotors is known from CN 101041237 A, wherein a plurality of cutting rotors are positioned along a circle around a central cutting rotor so that in total seven cutting rotors are arranged on the cutter head surface.

SUMMARY OF THE INVENTION

It is an objective underlying the present invention to provide for an improved personal care appliance and an improved tool head for such personal care appliance avoiding at least one of the disadvantages of the prior art and/or further developing the existing solutions. A more particular objective underlying the invention is to provide for an improved arrangement of the tooling rotors more efficiently using the available surface to increase tooling efficiency with a still small tool head. Another objective underlying the present invention is to allow for a better adaption of the tooling rotor field to the surface contour to be treated to avoid tooling rotors losing contact to the surface to be treated when the surface contour varies.

A further objective underlying the invention is to provide for an improved transmission architecture for transmitting the drive unit's action to the plurality of tooling rotors, wherein noise emissions from the drive train are low and power dissipation of the transmission structure is low. Another objective underlying the present invention is to allow for a space saving, compact drive train structure that can be accommodated within a small-sized tool head even when such tool head includes a rather high number of tooling rotors such as five, seven or ten or even more tooling rotors. A still further objective underlying the invention is to achieve smooth and quiet running of the drive train with low vibrations.

To achieve at least one of the aforementioned objectives, the number of tooling rotors is significantly increased while at the same time the size of the tooling rotors is significantly reduced, thus achieving smoother surface of the tooling rotor field. In particular, the rotor field of the tool head may comprise ten or more tooling rotors each having a diameter smaller than 1/12 of the length of an enveloping line enveloping said rotor field defined by said tooling rotors. More particularly, there may be more than twenty or even more than thirty tooling rotors each having a diameter of less than 1/25 of the length of said enveloping line around the rotor field.

According to another aspect, the tooling rotors are separately displaceably supported to elastically dive along their axes of rotation into a retracted position against a biasing force provided by biasing devices onto said tooling rotors, said support and biasing devices being configured to allow for a diving travel of at least one quarter of a diameter of a tooling rotor. Such significantly increased movability of the tooling rotors allows for a better self-adaption of the rotor field and the tooling rotors to the surface contour to be tooled.

The drive train may provide for an input crank element having connection means for connecting to a drive shaft, a transmitter element configured to be driven by said input crank element, and a plurality of output crank elements configured to be driven by said transmitter element to rotate about the rotor axes of the tool rotors and to rotatorily drive the tool rotors about said rotor axes. Said transmitter element distributes the driving action of the input crank element to the output crank elements, wherein said input crank element transforms the rotatory movement of the drive shaft into a revolving or orbiting movement of the transmitter element which is again retransformed into a rotatory movement by means of the output crank elements to rotatorily drive the tooling rotors.

Distributing the rotation of a drive shaft to a plurality of rotors through a crank mechanism allows for a simple and compact drive train architecture even when a large number of rotors are to be driven, wherein a large design freedom in positioning and varying the number of rotors is achieved. In addition, due to the crank mechanism transmitting the driving action of the common drive shaft to the plurality of rotors, a low noise operation with low vibrations can be achieved. More particularly, noise and vibrations caused by teeth of gear wheels and chain elements getting into engagement and getting out of engagement can be avoided.

These and other advantages become more apparent from the following description giving reference to the drawings and possible examples.

DETAILED DESCRIPTION OF THE INVENTION

Figure 1:
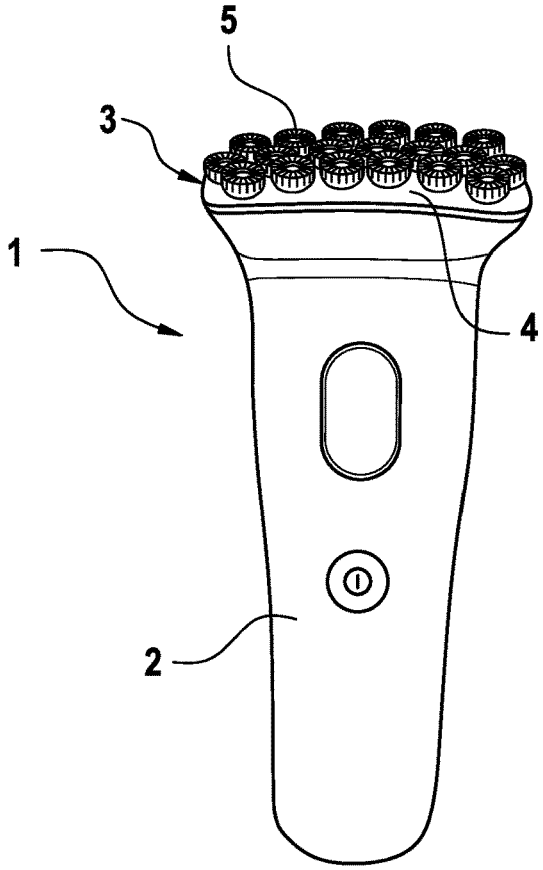
FIG. 1 is a perspective view of an electric shaver having a cutter head including a plurality of cutting rotors that can be rotatorily driven from a motor in the handpiece of the shaver via a drive train connecting the motor to the cutting rotors.

In order to more efficiently use the available functional surface of a tool head, i.e., the tool head surface facing or contacting the surface to be treated, the number of tooling rotors is significantly increased, whereas the size of the tooling rotors is decreased so as to allow for a smoother front face of the tooling rotor field with better adaption to the surface to be treated. More particularly, the tool head is provided with ten or more tooling rotors each having a diameter smaller than 1/12 of the length of an enveloping line around the rotor field defined by said tooling rotors. Said enveloping line may be a draft of traverse comprising a plurality of straight line sections each touching a pair of neighboring, outermost tooling rotors in terms of a tangent to said pair of neighboring tooling rotors. Said outermost tooling rotors may be the rotors defining the circumference or periphery of the rotor field and/or the rotors lying at the outer border of such rotor field.

In order to define an approximately smooth surface by the front faces of the tooling rotors, there may be more than twenty or even more than thirty tooling rotors each having a diameter of less than 1/25 of the length of said enveloping line.

More particularly, each rotor may have a diameter of less than 10 mm, for example in the range from 5 mm to 9 mm or in the range from 6 mm to 10 mm. It also would be possible to even further reduce the size of the tooling rotors, for example to a diameter range from 3 mm to 7 mm.

All tooling rotors or at least a subgroup of tooling rotors may have the same size, in particular the same diameter. Choosing the same diameter for all tooling rotors, or at least for 50% or 75% of the tooling rotors, allows for a dense arrangement with small distances between the tooling rotors. However, the plurality of tooling rotors may include one or more tooling rotors having a different size, in particular a different diameter. For example, the outermost tooling rotors positioned at corners of the rotor field may have increased sizes or smaller sizes than the other rotors.

In order to increase the ratio of the functional surface portion occupied by the tooling rotors to the ratio of the functional surface portion not covered by the tooling rotors, said tooling rotors may be positioned to have a distance between pairs of neighboring tooling rotors of less than 3 mm or less than 2 mm or less than 1 mm. The aforementioned ratio of the indeed active surface to the non-active surface may be considered to be the ratio of the sum of surface areas of the front surfaces of the tooling rotors to the sum of the surface areas of the dead spaces between the tooling rotors.

The arrangement of the tooling rotors in terms of their size and positioning and number can be chosen to have the aforementioned ratio of the functional surface portion covered by the tooling rotors to the entire functional surface area (i.e., the functional surface portion covered by the tooling rotors plus the functional surface portion not covered by the tooling rotors) to be 66% or more or 75% or more or 85% or more or 95% or more.

To achieve a dense and tight rotor arrangement, the tooling rotors may be arranged in at least three rows, each row including at least three tooling rotors, wherein said rows may extend substantially parallel to each other. More particularly, so as to reduce the dead spacing between neighboring rotors, said rows of rotors may have the same partition, i.e., the tooling rotors in each row may be spaced from each other at substantially the same distance. The distance between two neighboring rotors may be the distance of the centers thereof or the axis of rotation thereof. When considering two neighboring rows, the tooling rotors may be offset relative to each other in the longitudinal direction of the rows by ½ of the aforementioned partition or half the distance between the centers of two neighboring tooling rotors in a row. Such longitudinal offset allows for positioning the tooling rotors of a second row within the rhomb-shaped or gore-shaped spacing between neighboring tooling rotors of a first row. In other words, the tooling rotors of a second row may be positioned in the center of the spacing between two neighboring tooling rotors of a first row and two neighboring tooling rotors of a third row.

The tooling rotors may be arranged to define a substantially plane or flat rotor field surface. However, in order to better adapt the rotor field surface to non-planar skin areas or other surfaces to be treated, the tooling rotors, with their front faces, may be arranged at different heights so that the front faces of all tooling rotors define a non-planar rotor field surface. Depending on the surface to be treated, the heights of the tooling rotors may be chosen such that a concave and/or convex contour is defined by the front faces of the tooling rotors. Also, mixtures of concave and convex and flat contours or more generally, freely formed contours having convex and/or concave and/or planar sections may be formed. Depending on the surface contour to be treated, different tool heads with different rotor field contours may be chosen.

In order to achieve an improved self-adaption to varying surface contours such as plane surfaces, convex surfaces or concave surfaces or combinations thereof, the tooling rotors may be separately displaceably supported to elastically dive along their axes of rotation into a retracted position against a biasing force provided by biasing devices onto said tooling rotors, said support and biasing devices being configured to allow for a diving travel of at least ¼ of a diameter of a tooling rotor. The tooling rotors may dive along their axes of rotation during rotation or when they are driven to adapt during tooling a surface.

Depending on the type of tooling rotors, a diving travel of more than ⅓ or more than ½ of the tooling rotors diameter may be allowed. A good compromise between maximum adaption to different surface contours on the one hand and still simple, compact architecture of the tooling rotor support and drive train, can be achieved when said support and biasing means are configured to allow for a diving travel of 2 mm to 10 mm or 2 mm to 5 mm, wherein for some applications such as shaving a diving travel of 2 to 3 mm may be sufficient.

When the tooling rotors are urged into their retracted position due to pressing the tool head against the surface to be treated, the respective tooling rotors may be substantially flush with a functional tool head surface surrounding said retracted tooling rotors. On the other hand, when being in a projected position what may be effected by the biasing means when there is no or only less contact load onto the tooling rotors, said tooling rotors may have a height above said surrounding tool head surface of at least ¼ of the tooling rotors' diameter. For example, said height of the tooling rotors above the surrounding tool head surface may be, in the non-retracted position of the tooling rotors, in the range from 2 to 10 mm or 2 to 5 mm, wherein for certain applications such as shaving a height of 2 to 3 mm may be sufficient.

So as to allow for such diving of the tooling rotors along their axes of rotation, the drive train for rotatorily driving the tooling rotors may include drive pin portions for rotatably driving the tooling rotors, wherein said drive pin portions each may include a torque-transmitting connector for slidably connecting to each of said tool rotors to allow axial displacement of the tool rotor relative to said drive pin portion under torque. In other words, the tooling rotors may slide along said drive pin portions which rotatably drive said tooling rotors, wherein such sliding movement may be allowed even under torque.

In order to achieve a compact, small structure, the aforementioned biasing devices trying to urge the tooling rotors into their projecting or non-retracted position, may be integrated into said drive pin portion and/or into the tooling rotors. In addition or in the alternative, said biasing devices associated with the drive pin portions and/or the tooling rotors may include spring elements acting between said drive pin portions and said tooling rotors, in particular providing for a spring force acting in a direction substantially parallel to the axis of rotation of the tooling rotor.

More particularly, such spring elements may be accommodated within an interior recess in said drive pin portions.

In order to transmit the driving action of a drive shaft which may be the motor shaft of an electric motor or may be connected thereto by means of intermediate transmission elements, to a plurality of tooling rotors in the tooling head of a personal care appliance, the drive train connecting said drive shaft to the plurality of tooling rotors and distributing the driving torque of the drive shaft to each of the plurality of tooling rotors includes a crank mechanism comprising an input crank element having connection means for connecting to said drive shaft, a transmitter element configured to be driven by said input crank element and a plurality of output crank elements configured to be driven by said transmitter element to rotate about the rotor axes of said plurality of tooling rotors. Said tooling rotors may be connected to the rotating portions of the output crank elements in a torque-transmitting way. The input crank element may transform the rotation of the drive shaft into a revolving or orbiting, in particular circular movement of the transmitter element which orbiting movement is retransformed into a rotation of a shaft by means of said plurality of output crank elements driving the plurality of tooling rotors.

Said transmitter element forms a distributor distributing the action of the input crank element to the plurality of output crank elements and may have a substantially plate-like shape allowing for a thin, space-saving structure of the drive train and arrangement of the plurality of output crank elements, wherein such output crank elements may be arranged in different layout configurations. In particular, the positioning of the output crank elements and thus, the tooling rotors is not restricted to a circular arrangement where the tooling rotors are arranged along a circle about a center axis of the tooling head, but the output crank elements and the tooling rotors may be positioned in lines and rows like a matrix, or in a cloud-like distribution not conforming to a regular matrix, or in mixed positionings where a part of the rotors is positioned in a regular matrix and another part of the rotors and output crank elements is arranged in an irregular, cloud-like manner with different, non-uniform spacings therebetween.

The transmitter element, however, does not need to have a plate-like shape in terms of a plane plate in a mathematical sense, but it may have curvature and/or variations in thickness and/or recesses and other voids like a frame structure. For example, the transmitter element may be a thin body having a thickness significantly smaller than its extensions in two other axes. More particularly, the plate-like body may have a slightly curved shape about one axis like a wagon roof or about two axes like a dome-shaped roof, or may have a free formed curvature so as to adapt to the contour of the tooling head, more particularly to the contour of the field of tooling rotors. In the alternative, the transmitter element may have the shape of a plane plate, or a combination of plane portions and curved portions.

The transmitter element may include a plurality of connectors for rotatably connecting the output crank elements and the input crank element to said transmitter element. Said crank-connectors of the transmitter element may include receiving recesses therein such as bores or through-holes or pocket holes for rotatably receiving crank connection pins of said output and/or input crank elements. In a sort of kinematic reversion, the transmitter element may include connector pins forming the crank connectors of the transmitter element, which connector pins of the transmitter element may engage with recesses in the crank elements which may include bores or holes that can be rotatably fitted onto the connector pins.

Advantageously, the crank connectors of the transmitter element and the crank elements form a rotatory bearing allowing the crank elements to rotate relative to the transmitter element. Such rotatory bearings may be configured as friction bearing or sliding bearing supporting the transmitter element onto the crank elements.

Said transmitter element may be supported only by said crank elements, i.e., the input crank element and/or the output crank elements. More particularly, one may dispense with any additional bearings or supports for the transmitter element which is only held by the rotatory engagement with the input and output crank elements. Such floating or flying support of the transmitter element provides for a lightweight, compact and space-saving arrangement allowing for a thin, compact structure of the tooling head.

The aforementioned output and/or input crank elements themselves may be rotatably supported on a frame of the tool head, wherein all output crank elements may be supported on a common first frame portion and the input crank element may be supported on a second frame portion which first and second frame portions may be formed separately from each other or, in the alternative, may be part of the same common frame. In particular, said frame portions may be spaced from each other so that the transmitter element may be positioned in between said two frame portions. Also, the input and output crank elements may be positioned between said two frame portions, thus providing for a sort of sandwich structure where the input and output crank elements and the transmitter element connected thereto are sandwiched between two frame portions of the tool head. Such sandwiched frame structure allows for a premounted head structure which can be attached and detached to and from a handpiece of the personal care appliance.

Each of the input and output crank elements may be supported rotatably about a crank rotation axis fixed to the frame of the tool head so that each of the input and output crank elements may rotate about a fixed crank rotation axis relative to the body of the tool head.

The aforementioned crank rotation axes of the crank elements may extend in parallel to each other and/or in parallel to the axes of rotation about which the crank elements may rotate relative to the transmitter element. Arranging the crank rotation axes parallel to each other allows for easy configuration of the connection between the transmitter element and the respective crank elements. To avoid jamming of the crank mechanism, the crank elements may engage the transmitter element with play and/or may be loosely connected to the transmitter element. For example, the transmitter element may have bores or holes oversized with regard to the pins of the crank elements received therein so that the connection between the transmitter element and the output crank elements may provide for easy movability. Such loose fit between the input and/or output crank elements to the transmitter element also may be provided when all crank rotation axes are arranged exactly in parallel to each other. By means of such play between the crank elements and the transmitter element, manufacturing tolerances may be compensated and a smooth running and engaging of the drive train elements may be ensured. In particular, the output crank elements may be connected to the transmitter element with play transverse to the axes of rotation of the output crank elements.

Said plurality of output crank elements may have the same orientation and/or lever arms of said output crank elements may have longitudinal extensions parallel to each other. For example, in a specific phase of operation, all output crank elements may be oriented towards 3 o'clock, whereas in another phase of operation they may be oriented towards 6 o'clock. In other words, rotation of the output crank elements may be synchronized to extend in the same directions. The aforementioned lever arm of a crank element may be considered the linear connection between the crank rotation axis about which the crank element is rotatably supported on the tool head frame, to the axis of rotation about which the crank element is rotatably supported to the transmitter element.

The orientation of the input crank element may be aligned with, in particular parallel to the orientation of the output crank elements. For example, when the lever arm of the input crank element going from the crank rotation axis fixed to the frame to the axis of rotation fixed to the transmitter element, is oriented towards 6 o'clock, the lever arms of the output crank elements may be oriented towards 6 o'clock.

Said output crank elements and said input crank element may have crank lever arms of substantially the same lever length.

In order to achieve a specifically smooth and quiet running of the crank mechanism with very low vibrations, the transmitter element and the output and input crank elements may be designed in terms of their mass and/or in terms of the positioning of their center of gravity relative to their rotation axis such that the centrifugal forces of the input and output crank elements may be compensated by the centrifugal force of the transmitter element. Going on the assumption that the centrifugal force of the transmitter element goes into a direction opposite to the centrifugal forces of the input and output crank elements, the design of the input and output crank elements and the transmitter element, in particular the mass of the input and output crank elements and the mass of their transmitter element and the distance of the center of gravity of the input and output crank elements from the axis of rotation thereof and the distance of the center of gravity of the transmitter element from the center of rotation thereof can be chosen such that the respective centrifugal forces substantially compensate each other.

More particularly, going on the assumption that the centrifugal forces are balanced when the equation $$F_{plate}=F_{motorcrank}+n\cdot F_{crank}$$

is fulfilled, the aforementioned parameters mass and distance of the center of gravity of the respective element from the axis of rotation thereof can be derived from the equation defining the centrifugal force of each element $$F_x=\omega^2\cdot m_x\cdot r_x$$

with $F_x$ being the centrifugal force of an element x (such as the crank element or transmitter element), ω being the angular velocity, $m_x$ being the mass of the respective element x and $r_x$ being the distance of the center of gravity of a respective element x from the axis of rotation thereof. As all elements rotate at the same angular speed, ω applies to all elements.

In order to achieve a compensation or at least reduction of dynamically unbalanced mass or flyweight, the sum of the torques of the output crank elements relative to the transmitter element may be balanced by the torque of the input crank element relative to the transmitter element. To achieve such compensation, the aforementioned parameters $m_x$ and $r_x$ representing mass and distance of center of gravity from axis of rotation of a respective element x, may be chosen such that the following equation is fulfilled:

$$n\cdot F_{crank}\cdot a=F_{motorcrank}\cdot b,$$

with n being the number of output crank elements, $F_{crank}$ being the centrifugal force of an output crank element, a being the distance of the crank portions of the output crank elements from the transmitter element, more particularly the distance of the center of gravity of the output crank elements from the center of gravity of the transmitter element, and b being the distance of the input crank element from the transmitter element, more particularly the center of gravity of the input crank element from the center of gravity of the transmitter element and $F_{motorcrank}$ being the centrifugal force of the input crank element.

The aforementioned parameter mass m can be adjusted by means of different materials and/or different thickness of the elements and/or different dimensions of the elements. The aforementioned parameter distance r of the center of gravity from the axis of rotation as well as the parameters a and b may be adjusted by means of varying the geometry of the elements.

In order to avoid jamming or sticking of the entire crank mechanism and drive train due to jamming or blocking of one of the tool rotors which may occur when the respective tool rotor engages an obstacle and/or is pressed onto the surface to be treated with a contact pressure too high, a torque release device or a clutch device may be provided between the tooling rotor and the output crank element. For example, such torque release device or overload clutch may be integrated into the output crank elements, more particularly into the shaft portion of the output crank elements to which the tooling rotor is connected. If the tooling rotor is blocked or the rotational resistance of the tooling rotor becomes too high, such torque release device may allow the output crank element to rotate relative to the tooling rotor.

Such torque release device or overload clutch may be a friction clutch having two clutch elements locked with each other as long as the torque to be transmitted is below a certain threshold and, on the other hand, are allowed to rotate relative to the each other when the torque to be transmitted through the clutch exceeds a certain threshold. Such torque release mechanism may be achieved by means of friction elements elastically urged towards each other. In addition or in the alternative, magnetic forces may hold or release said two clutch elements.

These and other features become more apparent from the examples shown in the drawings. As can be seen from FIG. 1, the appliance may be a handheld personal care appliance in terms of, for example, a shaver 1 having an appliance housing 2 forming a handpiece for holding the appliance, which housing 2 may have different shapes such as—roughly speaking—a substantially cylindrical shape or box shape or bone shape allowing for ergonomically grabbing and holding the appliance, wherein such housing 2 may have a longitudinal housing axis due to the elongated shape thereof, cf. FIG. 1.

On one end of the housing 2, a tool head 3 in terms of a cutter head may be attached to the housing 2, wherein such tool head 3 may be pivotably supported about one or more tilting axes allowing for tilting adaption of the tool head 3 to the surface to be treated, i.e., the skin to be shaved without tilting the housing 2.

On its functional surface 4, the tool head 3 may have a plurality of tooling rotors 5 which may be embedded in or projecting from the tool functional surface 4. When the appliance is a shaver, said tooling rotors 5 may be cutting rotors for cutting hairs, wherein such cutting rotors 5 may include a plurality of blades or shearing edges cooperating with a perforated shear foil covering said cutting rotors 5.

Figure 2:
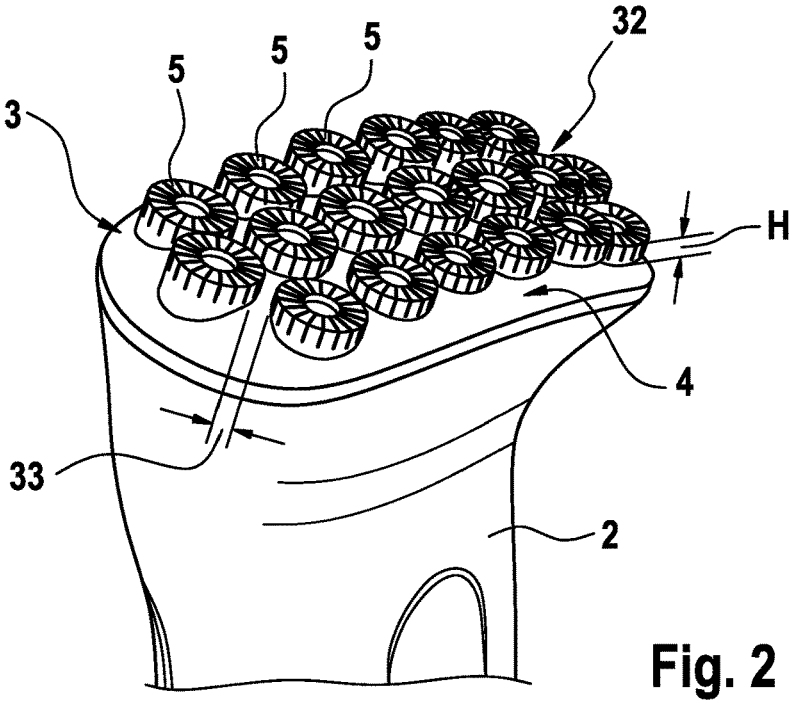
FIG. 2 is a partial, enlarged perspective view of the cutter head of the electric shaver of FIG. 1, showing the cutting rotors arranged in three rows having more than three rotors each.

As can be seen from FIG. 2, said tooling rotors 5 may be arranged—roughly speaking—in a common plane, wherein more particularly the tooling rotors 5 may be positioned along the functional surface 4 of the tool head 3 which functional surface 4 may have a slightly curved, in particular convex shape to better adapt to the surface to be treated. When the tooling rotors 5 project from said functional surface 4 by the same amount, i.e., the tooling rotors 5 have the same heights above said functional surface 4, the tooling rotors 5, with their front faces, define an enveloping surface or working surface corresponding in shape and contour to said functional surface 4. In other words, the tooling rotors 5 may have different heights or extensions in their axes of rotation to define different rotor field contours or rotor field surfaces such as a convex surface, a concave surface, a plane surface or mixtures thereof to achieve better adaption to the contour of the skin area to be shaved. As can be seen from FIG. 2, the tooling rotors 5 may be positioned in a plurality of rows one above the other, each row comprising a plurality of tooling rotors 5. Other positioning of the tooling rotors 5 are possible.

As can be seen from FIG. 2, more than ten or more than fifteen tooling rotors 5 can be arranged on the tool head 3.

So as to achieve an even more dense rotor arrangement, the rotor field 32 defined by the plurality of tooling rotors 5, may even comprise more than 20 or more than 30, for example 25 to 40 tooling rotors 5.

Each of the tooling rotors 5 can be rotatorily driven about a rotor axis 21, which rotor axes 21 can be arranged parallel to each other, in particular substantially perpendicular to the plane or perpendicular to the functional surface 4 of the tool head 3. Such rotor axes 21 may extend through the center of the tooling rotors 5 and/or may form an axis of symmetry of such rotors 5, wherein more particularly such rotor axis may extend substantially perpendicular to the engagement surface of the tooling rotors contacting the surface to be treated.

For example, the tooling rotors 5 may have a diameter of less than 10 mm, in particular within a range from 5 to 9 mm A good compromise between a dense arrangement and a still limited number of elements can be achieved with tooling rotors 5 having a diameter of 7 or 8 mm.

Figure 3:
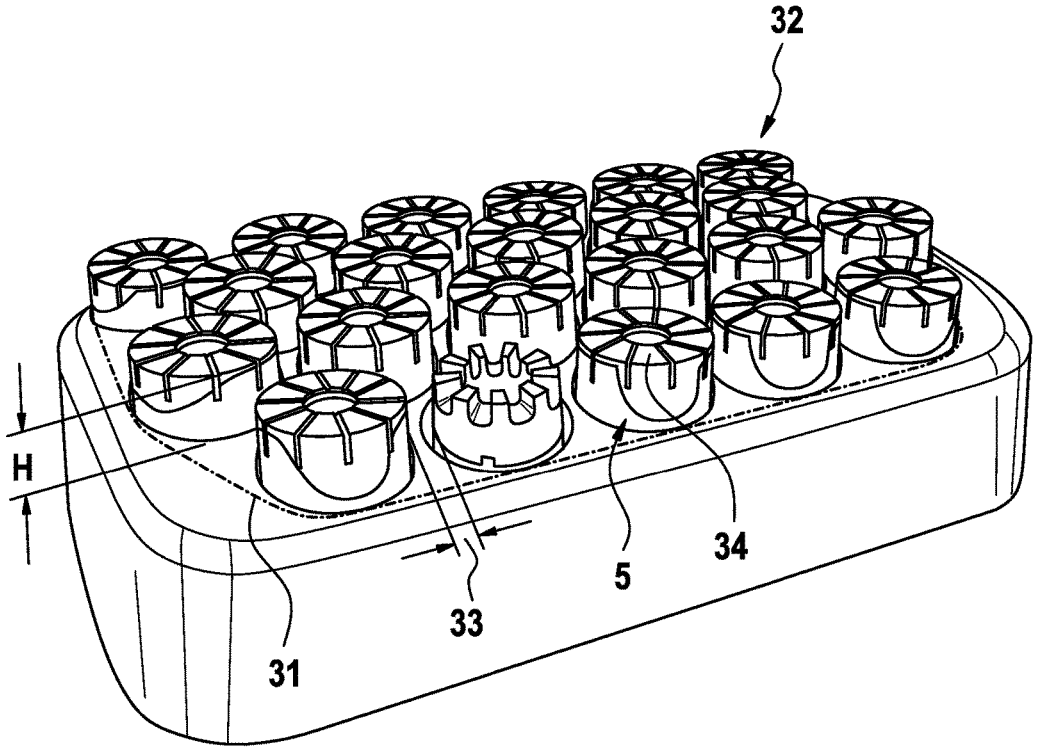
FIG. 3 is a perspective view of another tool head similar to the tool head of FIG. 2, but having four rows of tool rotors in a different arrangement, wherein one of the tooling rotors is shown without the covering shear foil to illustrate the configuration of the cutting rotor itself.
Figure 4:
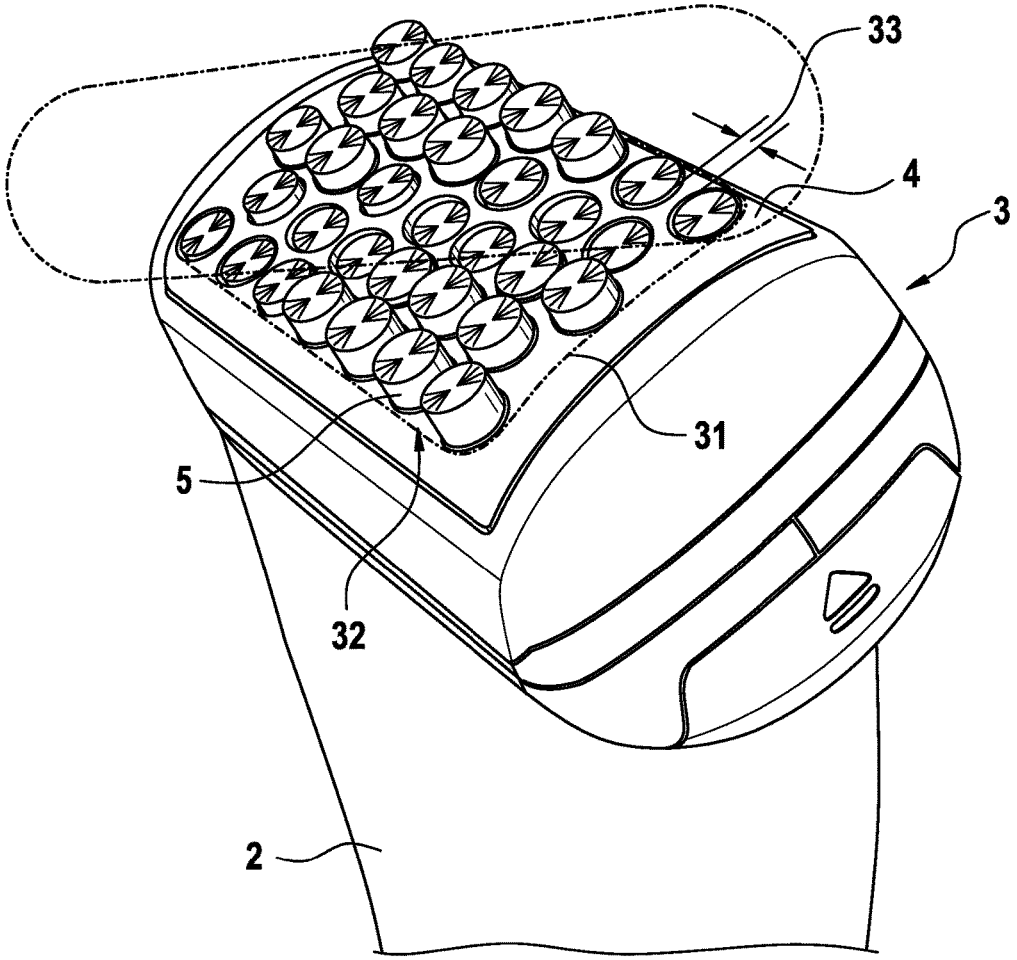
FIG. 4 is a perspective, partial view of a shaver and its cutter head including a plurality of cutting rotors in a still further arrangement having five rows of rotors, wherein a part of the cutting rotors are shown in a retracted diving position under the load of a finger, whereas other cutting rotors are shown in a non-retracted, projecting position.
Figure 5:
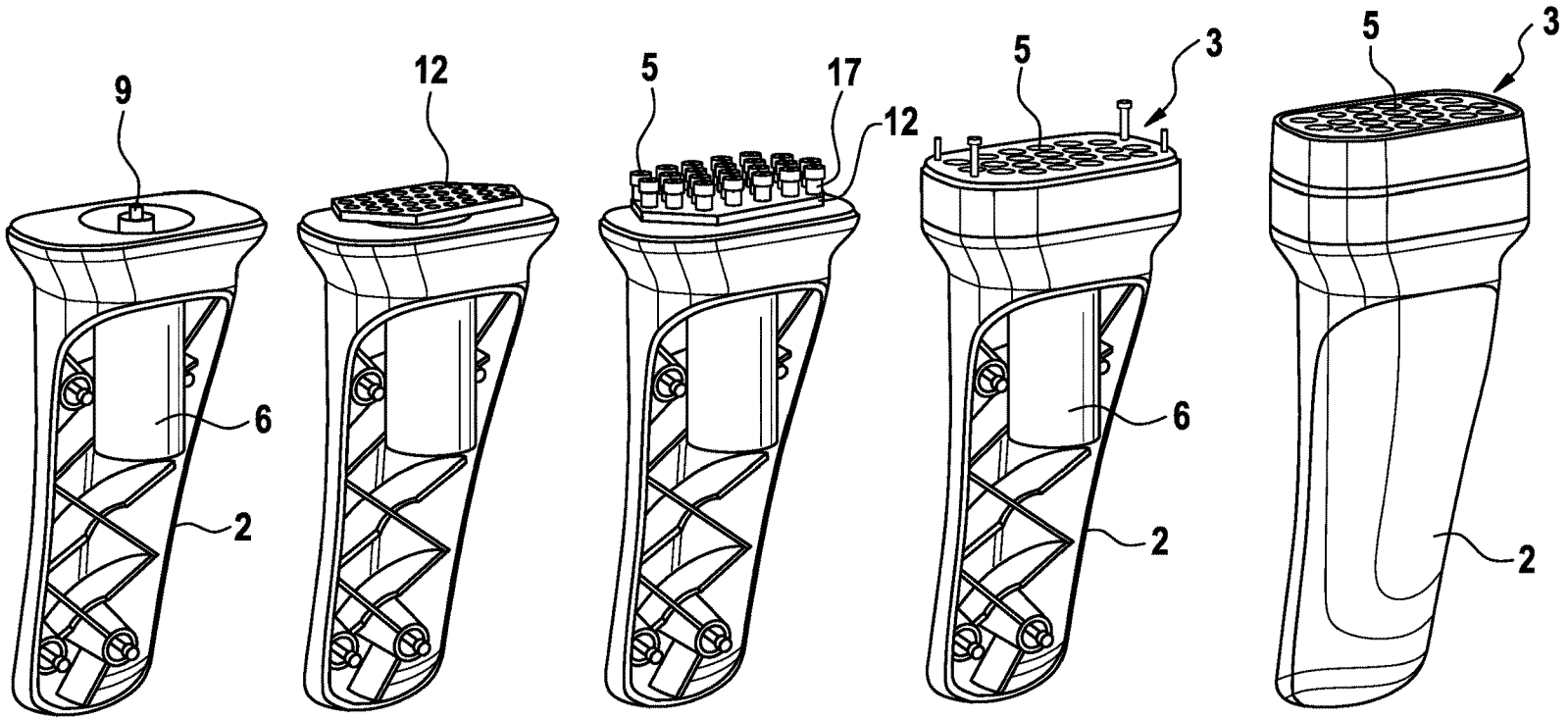
FIG. 5 is a schematic, perspective view of a shaver similar to FIG. 1, wherein the different views show different mounting stages of the cutter head.

As can be seen from FIG. 2, 3 or 4, the tooling rotors 5 are arranged very close to each other. For example, the distance or clearance 33 between pairs of neighboring tooling rotors 5 may be less than 3 mm, in particular 2 mm or less. For example, a clearance 33 of 1 mm may be provided.

The tooling rotors 5 may be arranged in a plurality of rows, each row including 3, 5, 10 or more rotors one after the other. For example, three or four or five rows of tooling rotors 5 may be provided, cf. FIG. 2, FIG. 3 and FIG. 4, wherein each row may include five to ten rotors.

So as to achieve a dense packaging of the tooling rotors 5, the tooling rotors 5 in neighboring rows may have an offset in the longitudinal direction of the rows. More particularly, with regard to the positions of the tooling rotors 5 in a first row, the positions of the tooling rotors 5 in a second row may be offset in the rows' longitudinal extension by half the distance between the center of two neighboring tooling rotors in a row. For example, as can be seen from FIG. 2, when considering the first two (most left) tooling rotors in the first and third row, the second tooling rotor of the second row may be positioned in the center of the space between said first two tooling rotors of the first and third row. Such longitudinal offset of the tooling rotors from row to row by half the partitioning distance of a row uses the rhomboid space between neighboring pairs of rotors. Thus, a high ratio of the functional surface area covered by the rotors 5 to the dead space therebetween is achieved.

As can be seen from FIG. 2 or 3, the tooling rotors 5 may have a rotationally symmetrical shape, in particular a cylindrical shape. However, other shapes such as a conical shape or a mushroom shape can be provided, wherein in particular any shape having circular cross-sections in all layers can be used.

The rotor field 32 in which the tooling rotors are arranged, can have different shapes, wherein—as can be seen in FIGS. 1 to 3—an enveloping line 31 surrounding said rotor field 32 may have a non-circular shape, in particular a—roughly speaking—rectangular or oval shape what may correspond with the overall contour and shape of the tooling head, cf. FIG. 3.

Figure 6:
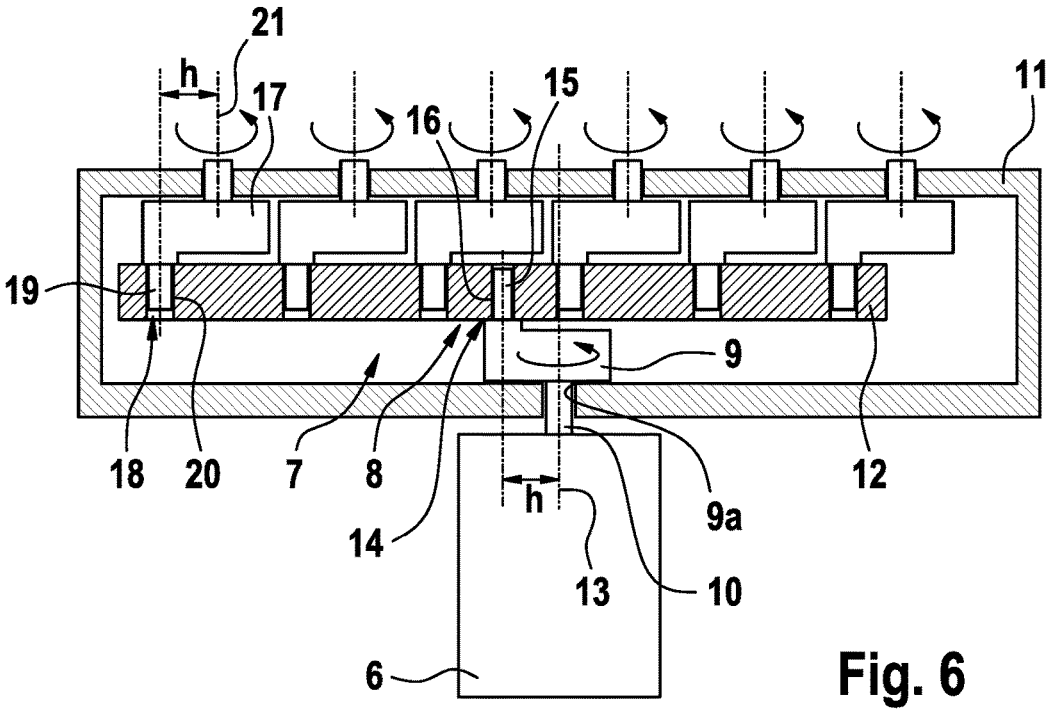
FIG. 6 is a schematic, cross-sectional view of the cutter head of the electric shaver of FIGS. 1 and 2, wherein the drive train including the input crank element, the transmitter element and the plurality of output crank elements are shown.

So as to rotatorily drive said tooling rotors 5, a motor 6 which may be an electric motor arranged in the housing 2 forming the handpiece of the appliance, may be connected to the tooling rotors 5 by means of a drive train 7 which is shown in FIG. 6. Such drive train 7 may include a crank mechanism 8 including an input crank element 9 transforming the rotation of a drive shaft 10 which may be the motor shaft of the motor 6 or an intermediate shaft coupled thereto, into a cranking movement or circular, orbiting movement about the axis of rotation 13 of said drive shaft 10. Said input crank element 9 may be rotatably supported at a frame portion of a frame 11 or a structural element of the tool head 3.

More particularly, the said input crank element 9 may drive a transmitter element 12 which may have a plate-like shape and/or a substantially flat body with main extension axes extending substantially transverse to the axis of rotation 13 of the input crank element 9. As can be seen from FIG. 6, the transmitter element 12 includes a crank connector which is rotatably connected to the input crank element 9. Said crank connector may form a rotatable bearing 14 in terms of, e.g., pin connection comprising an eccentric crank pin 15 rotatably received within a recess 16 in said transmitter element 12. The eccentric position of said crank pin 15 defines the lever arm h which corresponds to the distance of said crank pin 15 from the axis of rotation 13 of the input crank element 9. Advantageously, the axis of rotation of rotatable bearing 14 is substantially parallel with the axis of rotation 13 of the input crank element 9 relative to frame 11.

Due to the driving motion of the input crank element 9, the transmitter element 12 executes an orbiting or revolving movement along a circle about the axis of rotation 13 of input crank element 9.

Such movement of the transmitter element 12 is transmitted onto output crank elements 17 which are, on the one hand, rotatably connected to the transmitter element 12 and, on the other hand, rotatably supported by a frame portion of frame 11 of the tool head 3 or other structural elements of said tool head 3.

Similar to the input crank element 9, said output crank elements 17 are rotatably connected to the transmitter element 12 by means of rotatable bearings 18 which may be formed by crank pins 19 rotatably received in recesses 20 in the transmitter element 12. As can be also seen from FIG. 6, said output crank elements 17 are rotatably supported by frame 11 about axes of rotation 21 which are substantially parallel to each other and/or substantially parallel to the axis of rotation 13 of input crank element 9. Said axes of rotation 21 of the output crank elements 19 may extend coaxially to the rotor axes of the tooling rotors 5.

The crank pins 19 connecting the output crank elements 17 to the transmitter element 12 may be positioned eccentric with regard to the axes of rotation 21 of the output crank elements 17, wherein the distance between the crank pins 19 from the axes of rotation 21, i.e., the eccentricity of the crank pins 19 define the lever arms of the output crank elements 17, which lever arm h may correspond to the lever arm h of the input crank element 9.

As indicated by the arrows in FIG. 6, the input crank element 9 and the output crank elements 17 may rotate in the same direction and/or at the same rotational speed and/or in synchronized fashion relative to each other.

Figure 7:
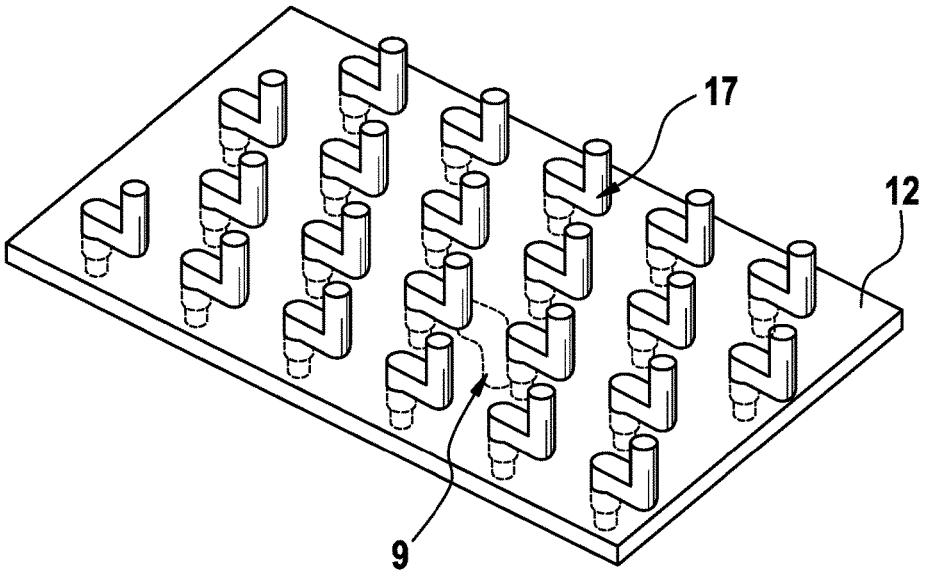
FIG. 7 is a perspective view of the drive train showing the parallel arrangement or orientation in the same direction of the crank elements for achieving a compensation of unbalanced masses and flyweights to achieve smooth running with low vibrations.

As can be seen from FIG. 7, the output crank elements 17 advantageously can be positioned and/or oriented in a way corresponding to each other. More particularly, the lever arms h of the output crank elements 17 may have the same orientations and/or may define longitudinal axes parallel to each other.

The input crank element 9 may have an orientation identical to the orientation of the output crank elements 17. More particularly, the lever arm h of the input crank element 9—one considering such lever arm going from the axis of rotation 13 to the crank pin 15—may extend in a direction parallel to the direction of the lever arms of the output crank elements 17 going from the respective axes of rotation 21 to the crank pin 19 thereof, cf. FIGS. 6 and 8.

So as to avoid jamming of the crank mechanism due to the various axes of rotation of the output crank elements 17, the rotatable bearings 18 connecting the output crank elements 17 to the transmitter element 12 may provide for some play transverse to the axis of rotation. More particularly, the recesses 20 in the transmitter elements 12 in which the crank pins 19 of the output crank elements 17 are received, may be a bit oversized to provide for a loose engagement of the crank pins 19. Such play of the crank pins 19 in the recesses 20 may compensate manufacturing tolerances and/or some inclination of the axes of rotation 21 of the output crank elements 19 relative to the each other.

According to an advantageous aspect, the transmitter element 12 and the output and input crank elements 17 and 9 may be designed in terms of their mass and geometry to substantially balance the centrifugal force of the transmitter element against the centrifugal forces of the input and output crank elements and to balance the torques of the output crank elements 17 onto the transmitter element 12 against the torque of the input crank element 9 theronto. In particular, the transmitter element, the input crank element and the output crank elements may be adapted such that the following equation is fulfilled:

$$F_{plate}=F_{motor\ crank}+n\cdot F_{crank},$$

with $F_{plate}$ being the centrifugal force of the transmitter element, $F_{motor\ crank}$ being the centrifugal force of the input crank element and $F_{crank}$ being the centrifugal force of each of the output crank elements.

This desired compensation of the centrifugal forces can be achieved by means of choosing the mass and distance of the center of gravity of the transmitter element 12 and the crank elements 9, 17, respectively, with the help of the following equation:

$$F_x=\omega^2 m_x r_x,$$

with $F_x$ being the centrifugal force of an element x (meaning the transmitter element 12, the input crank element 9 or the output crank element 17), ω being the angular speed of all elements and $r_x$ being the distance of the center of gravity of a respective element from the rotational axis thereof.

The said parameters mass $m_x$ and eccentricity $r_x$ of the center of gravity can be adjusted by means of choosing the material and adapting the geometry of the elements appropriately.

Thus, the static flyweight of the transmitter element may be compensated or at least significantly reduced.

Figure 8:
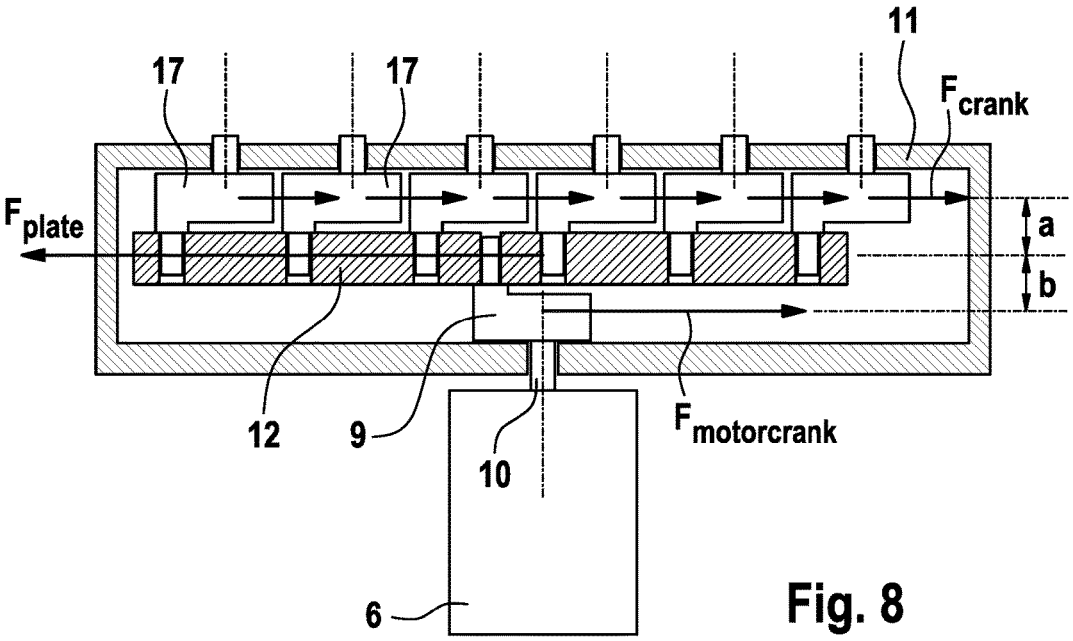
FIG. 8 is a cross-sectional view of the drive train similar to FIG. 3, wherein the kinetic forces of the running drive train elements are illustrated.

In order to compensate for the dynamic flyweight and torques of the input and output crank elements 9 and 17, said input and output crank elements 9 can be designed such that the following equation is fulfilled:

$$n\cdot F_{crank}\cdot a=F_{motorcrank}\cdot b,$$

with n being the numbers of output crank elements 17, $F_{crank}$ being the centrifugal force of the output crank element 17, a being the distance of the center of gravity of the respective output crank element 17 from a plane going through the center of gravity of the transmitter element 17 perpendicular to the axis of rotation thereof, $F_{motorcrank}$ being the centrifugal force of the input crank element 9 and b being the distance of the center of gravity of the input crank element 9 from the aforementioned plane containing the center of gravity of the transmitter element 12, cf. FIG. 8.

Again, compensation of the dynamic flyweight and the torques of the crank elements relative to each other, may be achieved by varying mass m and eccentricity r of the elements and distances a and b by means of adjusting material and geometry of the elements such that the aforementioned equation is fulfilled.

In order to achieve an improved self-adaption of the contour of the rotor field 32 and the positions of the tooling rotor 5 to the skin contour to be shaved, the tooling rotors 5 are separately displaceable to dive along their axes of rotation. In other words, each tooling rotor 5 individually may be lowered or may sink a bit into the structure of the tool head 3 so as to provide for a varying height of the tooling rotors 5 above the functional surface 4 of the tool head 3 from which said tool rotors 5 project. Such height H, cf. for example FIG. 3, may vary between 0—what means that the tooling rotor 5 is substantially flush with the functional surface 4—and several millimeters, for example 2 to 5 mm, in particular 2 to 3 mm when the tooling rotors 5 are in their unretracted, fully projecting position.

So as to allow for such diving movement of the tooling rotors 5, the support 27 of the tooling rotors 5 may include a torque-transmitting connector 29 for slidably connecting the tooling rotors 5 to the drive pin portions 28 of the output crank elements 17 to allow axial displacement of the tooling rotors 5 relative to the output crank elements 17 in a direction substantially parallel to the axis of rotation of the tooling rotors. For example, such torque-transmitting connector 29 may include a shaft-sleeve-connection including non-circular cross-sections so as to be able to transmit torque. For example, there may be spline-shaft-connection or a polygonal profile shaft-sleeve-connection allowing to telescope a shaft portion relative to a sleeve portion.

In order to urge the tooling rotors 5 towards their non-retracted, fully projecting position, biasing devices 26 may be associated with said slidable connector 29. More particular, such biasing devices 26 may be integrated into the telescoping connector 29. For example, a spring 30 may be accommodated within the internal recess of the sleeve-like component in which the shaft-like component of the telescoping connection is received, said spring urging the shaft-like component further outwards.

Figure 9:
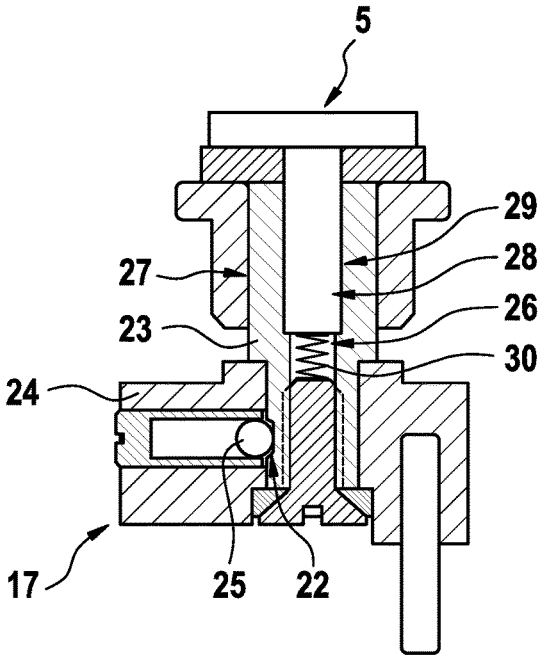
FIG. 9 is a cross-sectional view of a crank element having an overload clutch.

Although not shown in FIG. 9, it is not only the rotatorily driven tooling rotor 5 which can dive along its axis of rotation, but also the non-rotating outer cover or outer member cooperating with the rotating tool rotor 5, which outer member can be a perforated shear foil covering the front surface of the tooling rotor. Such outer member 34 can be seen from FIG. 3, where one of the tooling rotors 5 is shown without such outer member 34 or shear foil, namely the second tooling rotor from the left in the front row of tooling rotors 5, whereas the other tooling rotors 5 are shown with such covering shear foil 34.

Such outer member 34 may also dive with the rotating tooling rotor 5, wherein it is biased—via the tooling rotor 5—by the aforementioned biasing device 26.

The support 27 including the aforementioned torque-transmitting, slidable connector 29 and the biasing devices 26 are configured to allow for a diving travel of at least 2 mm, wherein also a diving travel of 3 or 4 or 5 or 6 mm may be allowed.

FIG. 4 shows that the tooling rotors 5 may individually dive, depending on the contour of the surface pressing against the tool head 3.

As can be seen from FIG. 9, the output crank elements 17 may include an overload clutch 22 allowing for rotation of the output crank element 17 relative to the tool rotor 5 attached thereto when a predetermined rotational resistance of the tooling rotor 5 is achieved or exceeded. Such overload clutch 22 may include a rotor piece 23 which is rotatably connected to a body piece 24 of the respective output crank element 17, wherein such rotor piece 23 may rotate relative to body piece 24 about a clutch axis substantially coaxial with the axis of rotation 21 of the output crank element 17 and/or coaxial to the rotor axis of the tooling rotor 5. In order to avoid such rotation of the rotor piece 23 of the overload clutch 22 relative to body piece 24 under normal conditions, a rotation preventer 25 may be associated with the rotor piece 23 and/or the body piece 24. Such rotation preventer 25 may include frictional engagement pieces attached to the rotor piece 23 and the body piece 24 and urged against each other. Other rotation preventers such as magnetic elements may be provided.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A tool head for a personal care appliance, including a plurality of tooling rotors rotatably supported about rotor axes and a drive train for rotatably driving said tooling rotors from a motor, wherein the tooling rotors are separately displaceably supported to elastically dive along their axes of rotation into a retracted position against a biasing force provided by biasing devices onto said tooling rotors, said biasing devices being configured to allow for a diving travel of at least about ¼ of a diameter of a tooling rotor, wherein said drive train includes:

an input crank element having connection means for connecting to a drive shaft, said input crank element being rotatably supported about a first crank rotation axis, wherein a first crank connecting pin is attached to said input crank element at a position eccentric to said first crank rotation axis, said input crank element having a first crank lever arm (h) defined by a distance between said first crank connecting pin and said first crank rotation axis;

a transmitter element configured to be driven by said input crank element; and a plurality of output crank elements configured to be driven by said transmitter element to rotate about said rotor axis, said output crank elements being rotatably supported about second crank rotation axes and second crank connecting pins being attached to each of said output crank elements at a position eccentric to a respective one of said second crank rotation axes, wherein said output crank elements each have a second crank lever arm (h) defined by a distance between said second crank connecting pins and said respective one of said second crank rotation axes, wherein said first and second crank rotation axes are parallel to each other and said first and second crank lever arms (h) have substantially a same lever length.

2. The tool head according to claim 1, wherein said biasing devices are configured to allow for a diving travel greater than about ⅓ of the tooling rotors' diameter or greater than about ½ of the tooling rotors' diameter.

3. The tool head according to claim 1, wherein in said retracted position, the tooling rotors are substantially flush with a functional tool head surface surrounding the tooling rotors, whereas in a projecting position, the tooling rotors have a height above said surrounding tool head surface of at least about ¼ of the tooling rotors' diameter.

4. The tool head according to claim 1, wherein said drive train includes a drive pin portion for rotatorily driving said tooling rotors, wherein said drive pin portions each include a torque transmitting connector for slidably connecting to each of said tooling rotors to allow axial displacement and thus, diving of said tooling rotor relative to said drive pin portion under torque.

5. The tool head according to claim 4, wherein said biasing devices are integrated into said drive pin portions and/or into said tooling rotors and/or wherein said biasing devices include spring elements acting between said drive pin portions and said tooling rotors.

6. The tool head according to claim 1, wherein said plurality of tooling rotors include at least ten tooling rotors each having a diameter smaller than about 1/12 of a length of an enveloping line enveloping a rotor field defined by said tooling rotors.

7. The tool head according to claim 6, wherein said plurality of tooling rotors include more than twenty or more than thirty tooling rotors each having a diameter of less than about 1/25 of the length of said enveloping line.

8. The tool head according to claim 1, wherein each tooling rotor has a diameter of less than about 10 mm.

9. The tool head according to claim 1, wherein a distance between neighboring pairs of tooling rotors is less than about 2 mm.

10. The tool head according to claim 1, wherein said tooling rotors are arranged to define a rotor field having a rectangular or oval enveloping line.

11. The tool head according to claim 1, wherein said tooling rotors are arranged in at least three rows, each row including at least three tooling rotors, wherein the tooling rotors in any two neighboring rows are offset relative to each other in the rows' longitudinal extension by half the distance between the centers of two neighboring tooling rotors in a row.

12. The tool head according to claim 1, wherein the tooling rotors are arranged to define a rotor field having an enveloping area less than about 4/3 of the sum of front surface areas of the plurality of tooling rotors.

13. The tool head according to claim 1, wherein the tooling rotors are arranged at different heights with respect to one another to define a rotor field surface having a convex and/or concave contour and/or a contour having concave and/or convex and/or flat sections.

14. The tool head according to claim 1, wherein said transmitter element has a plate-like contour and/or a flat body with main extension axes transverse to the rotor axis, wherein said transmitter element includes a plurality of receiving recesses therein such as bores for rotatably receiving crank connection pins attached to the output crank elements.

15. The tool head according to claim 1, wherein said transmitter element is supported only by the output crank elements, said input crank element, or a combination thereof.

16. The tool head according to claim 1, wherein the transmitter element and the output and input crank elements are designed in terms of their mass (m) and their eccentricity (r) of their center of gravity from the rotation axis such that the centrifugal force of the transmitter element is compensated by the centrifugal forces of the input and output crank elements.

17. A personal care appliance comprising a tool head comprising a plurality of tooling rotors rotatably supported about rotor axes and a drive train for rotatably driving said tooling rotors from a motor, wherein the tooling rotors are separately displaceably supported to elastically dive along their axes of rotation into a retracted position against a biasing force provided by biasing devices onto said tooling rotors, said biasing devices being configured to allow for a diving travel of at least about ¼ of a diameter of a tooling rotor and a housing forming a handpiece and supporting said tool head, wherein said drive train includes:

an input crank element having connection means for connecting to a drive shaft, said input crank element being rotatably supported about a first crank rotation axis, wherein a first crank connecting pin is attached to said input crank element at a position eccentric to said first crank rotation axis, said input crank element having a first crank lever arm (h) defined by a distance between said first crank connecting pin and said first crank rotation axis;

a transmitter element configured to be driven by said input crank element; and a plurality of output crank elements configured to be driven by said transmitter element to rotate about said rotor axis, said output crank elements being rotatably supported about second crank rotation axes and second crank connecting pins being attached to each of said output crank elements at a position eccentric to a respective one of said second crank rotation axes, wherein said output crank elements each have a second crank lever arm (h) defined by a distance between said second crank connecting pins and said respective one of said second crank rotation axes, wherein said first and second crank rotation axes are parallel to each other and said first and second crank lever arms (h) have substantially a same lever length.

18. The personal care appliance according to claim 17, wherein said housing accommodates said motor for driving the tooling rotors via the drive train.

* * * * *